United States Patent [19]

Schmidt, Jr. et al.

[11] Patent Number: 4,828,310

[45] Date of Patent: May 9, 1989

[54] PACKAGE HANDLE

[75] Inventors: Arnold W. Schmidt, Jr.; James E. Habeck, both of Janesville, Wis.

[73] Assignee: Habitec International, Inc., Janesville, Wis.

[21] Appl. No.: 177,146

[22] Filed: Apr. 4, 1988

[51] Int. Cl.[4] ..... A45C 13/26; B65D 71/00

[52] U.S. Cl. ..... 294/153; 294/150; 294/154

[58] Field of Search ..... 294/153, 149, 148, 150, 294/154, 155

[56] References Cited

U.S. PATENT DOCUMENTS

| | | | |
|---|---|---|---|
| 512,722 | 1/1894 | Ward | 294/154 |
| 622,958 | 4/1899 | Lay | 294/150 |
| 1,719,753 | 7/1929 | Brunzell | 294/150 |
| 2,561,911 | 7/1951 | Cremona | 294/150 |
| 2,832,521 | 4/1958 | Gardner | 294/150 |

*Primary Examiner*—James B. Marbert

*Attorney, Agent, or Firm*—Barnes, Kisselle, Raisch, Choate, Whittemore & Hulbert

[57] ABSTRACT

A package handle carrier which provides a means for carrying packages, containers or equivalent with one hand. The package handle includes a pivoted top-nested carrying handle mounted on the top of a relatively flat compact box. The box contains two spring tensioned retractable tape reels rotatably mounted in the box in side by side relationship with their axes parallel. Each tape free end has a T-bar rod secured thereto which is insertable into an anchor clasp socket in the associated opposite wall of the box to hook the free end of the tape thereto. Each reel has an upwardly protruding fluted rewind knob for manually drawing up the tape, and a spring biased reel ratchet lock to engage the knob flutes to positively one-way lock the tape in taut condition about the package to be carried.

13 Claims, 3 Drawing Sheets

FIG. 3
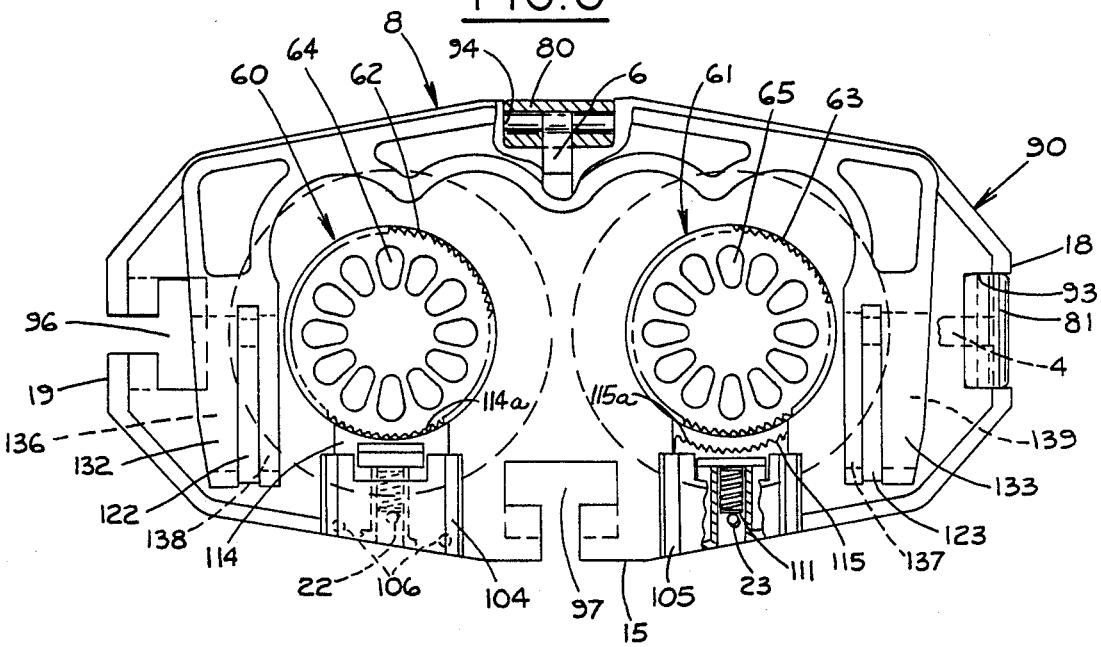
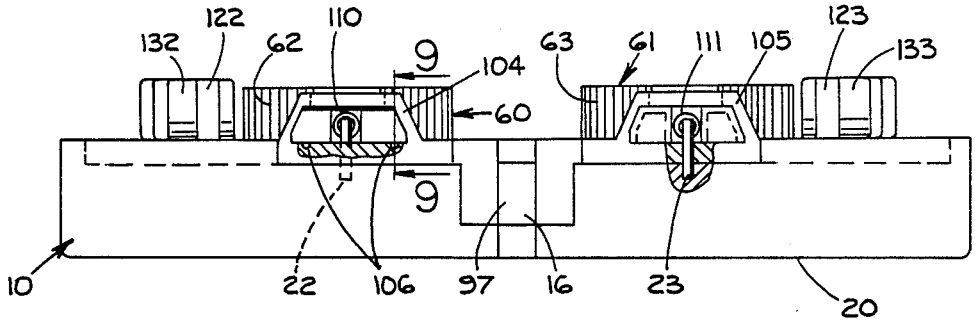
FIG. 4
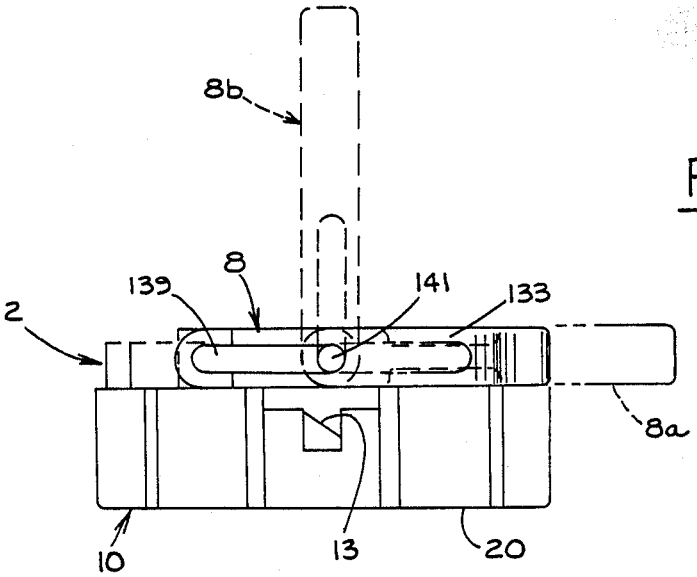
FIG. 5

FIG.6
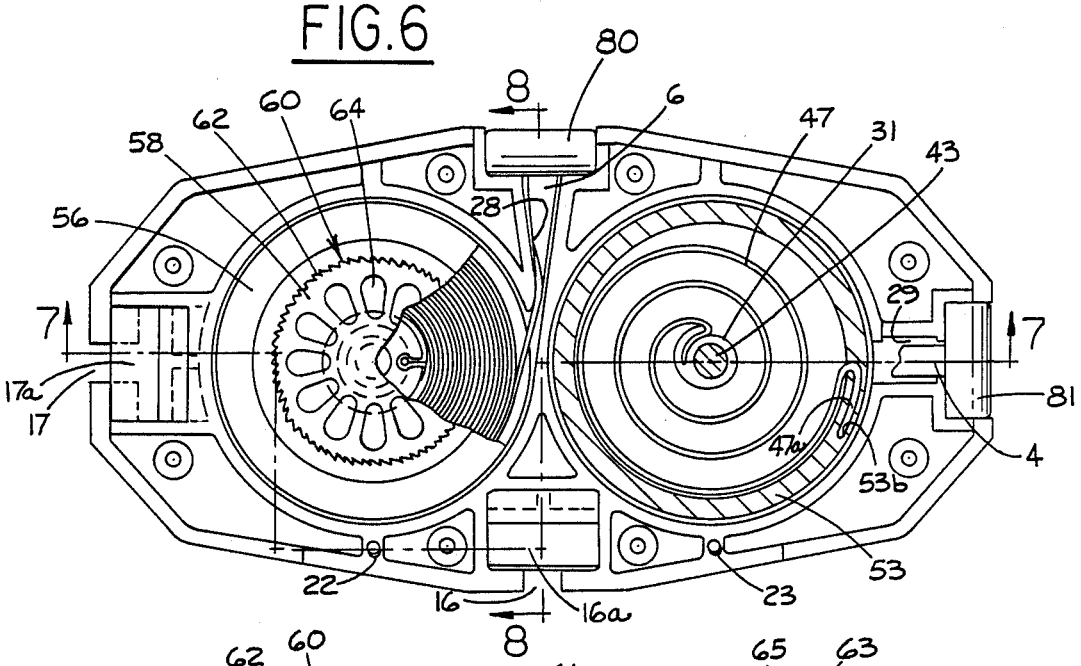
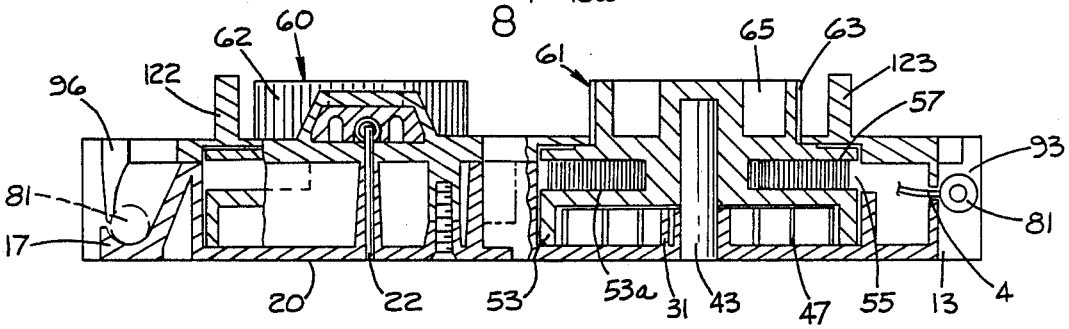
FIG.7
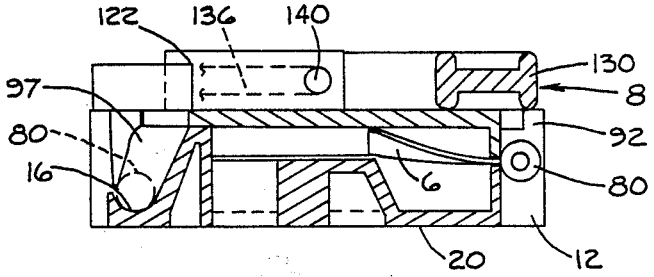
FIG.8
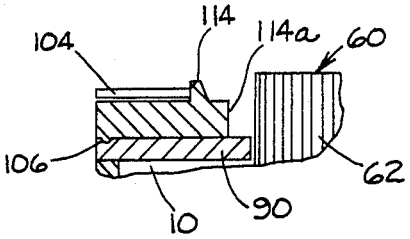
FIG.9

PACKAGE HANDLE

The present invention relates generally to means for carrying packages, containers or equivalent, and more particularly to an improved package handle for holding together and carrying packages, containers or equivalent for one hand operation.

Throughout history the problem of manually moving objects from one place to another has been addressed by many inventions. For example, the Ward U.S. Pat. No. 512,772 discloses a self-contained relatively compact flat box with a folding handle attached thereto, but with non-retractable chains or other suitable flexible material which were stored loosely in the flat box when not in use. However, the Ward patent solution still left certain problems for the user to overcome, such as (1) the chain or other suitable material knotting or intertwining while not in use inside the box, (2) the inconvenience of having to open the box and untangle the chain or other suitable material to wrap around the package, and (3) the time and care necessary to put the chain or other suitable material in the box when the job was completed.

Other prior art approaches to the problem of rendering package carrying more convenient are disclosed in the following U.S. Pat. Nos.:

191,175, Raffel
192,388, Randall
231,975, Voos
424,578, Rowe
451,627, Stepp
512,772, Ward
622,958, Lay
748,293, LeFevre
1,719,753, Brunzell
2,561,911, Cremona
2,997,218, Kobles
3,865,292, Foley However, these prior art approaches still left much to be desired with respect to excess bulkiness and/or cost and lack of convenience and/or reliability.

Accordingly, an object of this invention is to provide an improved apparatus to carry objects from one point to another quickly and efficiently with ease of one hand operation.

Another object of the invention is to provide a package carrier of the aforementioned type which provides a convenient and orderly storage area for a strong and flexible wrapping material, and yet which is sufficiently compact to be carried in a suit pocket, purse or briefcase.

A further object of this invention is to provide a carrier of the aforementioned type capable of positively locking the tape in a taut position around the object to be carried.

BRIEF DESCRIPTION OF THE DRAWINGS

Other objects as well as features and advantages of the present invention will become apparent from the following detailed description in connection with the appended drawings, wherein:

FIG. 3 is a top plan view of the carrier of FIGS. 1 and with portions broken away for purposes of illustration.

FIG. 4 is a side elevational view of the carrier of FIG. 3 with portions broken away for purposes of illustration.

FIG. 5 is an end elevational view of the carrier of FIGS. 1–4 with the vertical position of the carrier handle shown in phantom.

FIG. 6 is a top plan view of the carrier of FIGS. 1–5 without the case cover, with portions broken away for purposes of illustration.

FIG. 7 is a sectional view taken along line 7—7 in FIG. 6 with case cover in place.

FIG. 8 is a sectional view taken along line 8—8 in FIG. 6 with case cover and handle in place.

FIG. 9 is a fragmentary sectional view taken along line 9—9 of FIG. 4.

BRIEF DESCRIPTION OF PREFERRED EMBODIMENTS

Figure 1:
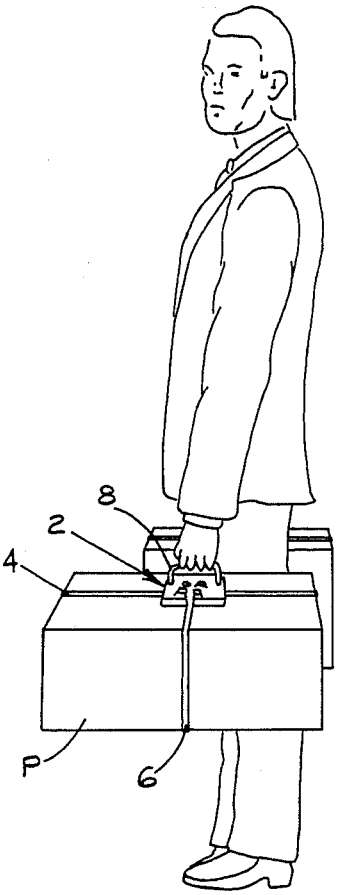
FIG. 1 is a perspective view of a person holding an exemplary but preferred embodiment of a handle strap carrier of this invention with its straps wrapped around a container, package or equivalent.

Referring in more detail to the accompanying drawings, an exemplary but preferred embodiment of a handle strap carrier apparatus 2 of the invention is shown in FIG. 1 with its straps secured around a package P or equivalent and held by an individual in its operative position. FIG. 1 shows the package handle apparatus 2 with its two tape straps 4 and 6 wrapped around the package and crossing perpendicularly on the underside of the package. The individual holds the entire package P with one hand by engaging the vertically disposed handle 8 of carrier 2.

Figure 2:
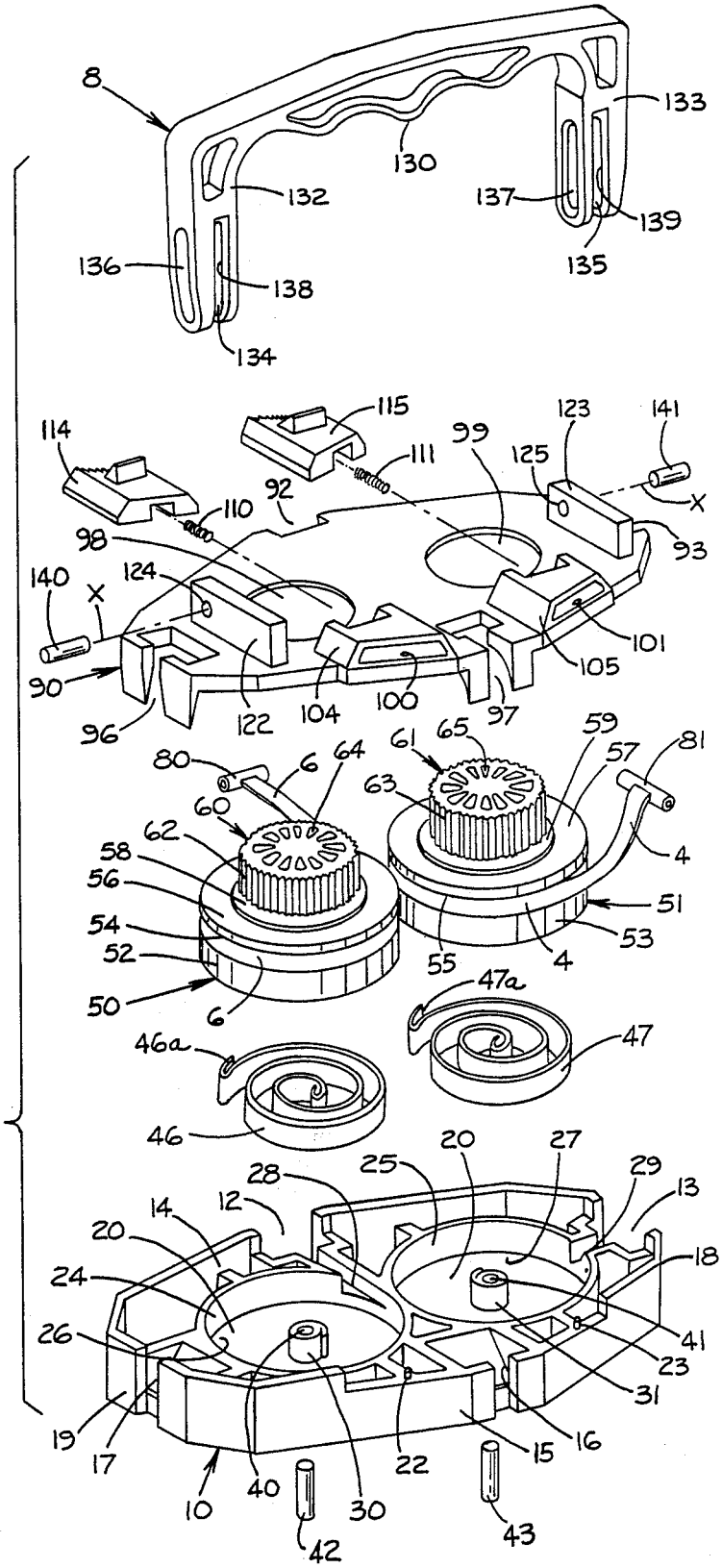
FIG. 2 is an exploded perspective view of the handle strap carrier apparatus of FIG. 1.

The assembly of the package handle carrier 2 is shown in FIG. 2 in an exploded perspective disassembled relationship to facilitate understanding. A case 10 provides a base for the entire assembly. Case 10 is preferably injection molded from a suitable plastic material, such as 10 percent glass filled ABS, into an essentially rectangular shape with two tape distributing cavities 12, 13 and two tape anchor clasp sockets 16, 17. One anchor receiving cavity 12 is located on the center of the long far sidewall 14 of case 10 with its corresponding anchor clasp socket 16 directly opposite on the near long wall 15 of case 10. The other distributing cavity 13 is on the center of the short far sidewall 18 with anchor clasp socket 17 directly across on the near short wall 19 of case 10. The relationship between these cavities and clasp sockets will be discussed below. Also located on top of the near long sidewall 15 are two lock spring keeper pins 22, 23. Case 10 has an imperforate bottom wall 20 which extends throughout the case underside and supports the entire apparatus.

Side by side along the lengthwise axis X of case 10 are two interior cylindrical walls 24, 25 which define tape reel cavities 26, 27. Cavities 26 and 27 communicate respectively with cavities 12, 13 through tape leader passage openings or slots 28 and 29 respectively. Rewind spring keeper posts 30 and 31 protrude upwardly from, and are integral with, bottom wall 20, and are respectively disposed centrally and coaxially with tape reel carriage walls 24 and 25. Posts 30 and 31 have reel journal post through-bores 40 and 41, respectively, which respectively receive reel journal posts 42 and 43 (FIGS. 2, 6 and 7).

Tape reel cavities 26 and 27 respectively contain two tape rewind spiral springs 46 and 47 which couple at their inner end with the spring keepers 30 and 31 respectively to hold the center of each spring stationary. Disposed over and individually around springs 46, 47 and within walls 24, 25 are placed a pair of tape reel composite hubs 50 and 51. Hubs 50 and 51 are identical and comprise a molded piece consisting of a cylindrical skirt 52, 53, which acts as a rewind spring housing, and a bottom wall 52*a*, 53*a* for partially defining an annular recess 54, 55 in the reel hub for receiving tape 6 and 4 respectively. The outer end tangs 46*a* and 47*a* of rewind springs 46 and 47 respectively hook into anchor slots 52*b* and 53*b* in skirts 52 and 53 to rotatably bias the hubs for tape rewinding. Hubs 50 and 51 also each have an upper wall 56 and 57 further defining the tape recess 54, 55 and which also provides the platform for a bearing shoulder 58, 59 and tape takeup knob 60, 61. On the entire circumferential area of takeup knob 60, 61 are vertical flutes 62, 63 which (1) provide a finger gripping surface on the knob to manually rotate the same when taking up slack in the associated tape strap, and (2) act as a ratchet wheel to lock the takeup reels into position. Knobs 60 and 61 also have cored-out blind pockets opening 64, 65 at their top surface to reduce weight and for aesthetic appeal.

Within tape strap annular recesses 54 and 55 are respectively wound the tape straps 6 and 4, each of which is made of a flexible synthetic material such as nylon webbing, capable of withstanding a tensile load of 120 pounds. Attached to the outer end of each tape strap 4 and 6 is an anchor in the form of a T-bar rod 80, 81.

A case cover 90 fixedly fits over the case 10. Cover 90 has anchor receiving cut-outs 92, 93 with respectively mirror locations of base cavities 12 and 13, and has T-shaped anchor slots 96 and 97 which overlie anchor clasp sockets 16 and 17 to provide drop-in passages for the T-bar rods 80 and 81 and tape straps 4 and 6 when placing rods 80 and 81 onto inclined anchor seats 16*a* and 17*a* within anchor clasp sockets 16 and 17. Case cover 90 also has takeup reel knob openings 98 and 99, through which reel knobs 60 and 61 respectively protrude above the top surface of case cover 90.

Cover 90 has a pair of bores 100 and 101 equally spaced from the sides of the anchor slot 97 which receive pins 22 and 23 (FIGS. 4 and 7). A pair of reel lock housings 104 and 105 are provided on the top surface of cover 90, over pins 22 and 23, and laterally adjacent knobs 60 and 61, which slidably receive reel lock detents 114 and 115 respectively. Each detent is yieldably biased toward the fluted surface of the associated knob by a compression coil spring 110, 111, the springs being captured between pins 22, 23 and detents 114, 115. Springs 110, 111 urge the reel locks 114, 115 into contact with flutes 62, 63 on knobs 60, 61, to thereby function as a releasable pawl and ratchet mechanism.

Two rectangularly shaped handle mounting ribs 122, 123 are provided on the top of cover 90 spaced inwardly from the short side edges 18 and 19. Pivot pin bores 124, 125 extend through ribs 122, 123 and are coaxially aligned with each other along the lengthwise center line axis X of carrier 2.

Carrier 2 is provided with a pivoted, top-nestable carrying handle 8. Handle 8 is generally U-shaped and comprises a central bight portion 130 with wave shaped molded onto the underside to provide a finger grip area to be grasped by the fingers of one hand of a person. Extending down from each end of the central portion are legs 132, 133 each having an elongated opening or slot 134, 135 with a length equal to that of the mounting ribs 122, 123. In the sides of each leg 132, 133 are a pair of elongated slots 136, 138 and 137, 139. Pivot pins 140, 141 press-fit mounted in bore 124, 125 protrude into the handle leg slots 136, 138, 137, 139 to thereby capture the handle on the mounting ribs 122, 123.

In use, the above described handle strap carrier 2 is well adapted to carry any package, object or equivalent up to a given overall dimension and weight. When not in use, handle 8 is folded into a nested position flat on the cover 90 to provide the compact structure as shown in solid lines in FIG. 5. The phantom positions 8*a* and 8*b* shown in FIG. 5 respectively illustrate the slide-out and upright in-use positions of handle 8.

To secure carrier 2 to a package or object to be carried, carrier 2 is first placed on top of the object. Then, after sliding detent 114 to release position (FIG. 9), where it is releasably held by detent 106, one of the T-bar rod anchors 80, for example, is pulled from cavity 12 with enough force to withdraw the attached tape strap 6 from cavity 26 through the tape passage 28, thus unwinding tape 6 from its associated spring tensioned reel 60. The tape strap 6 is wrapped down the one side, around the bottom, up the opposite side and thence over the top of the package to bring anchor 80 into registry with anchor slot 97 on the carrier 2. T-bar rod 80 is then pushed through T-slot 97 and down into seated position in anchor socket 16. T-bar rod 80 will be held seated and any slack taken out of the tape strap 6 by knob 60 being turned clockwise by the constant rewind biasing force exerted by spring 46. Preferably, as soon as T-bar rod 80 is seated in socket 16, detent 114 is pushed free of detent 106 so that the detent teeth 114*a* once again engage flutes 62 (FIG. 3). Knob rotation in this slack takeup direction is permitted even though detent 114 remains in spring-biased engagement with flutes 62 due to the pawl and ratchet action. This simulates a pawl and ratchet wheel configuration, thereby preventing any tape withdrawing load from overcoming spring rewind biasing force, such loading urging the reel lock teeth 114*a* to mesh with the flutes 62 to prevent the knob from rotating counterclockwise and allowing the tape strap to loosen from around the package.

On the other hand, if additional tape takeup force is needed to augment that of spring 46, knob 60 can be manually rotated clockwise while detent 114 remains knob-engaged, due its ratcheting action. This also insures against retrograde rotation by tape withdrawing loads during release intervals when manually rotating knob 60 in the clockwise takeup direction.

The same tape-attachment and takeup procedure is repeated for T-bar anchor 81 and tape strap 4. Note that tape strap 4 will perpendicularly cross tape strap 6 on the underside of the package directly below the package handle apparatus 2. Once T-bar 81 is secured in anchor clasp 17, handle 8 can be raised vertically to the in-use position and the package P is ready to be manually transported while tape-suspended from carrier 2.

Once the destination has been reached and it is desired to remove carrier 2 from package P, the tape reel locks 114, 115 are pushed against their springs 110, 111 in tape reel housing 104, 105 and locked into release position by detents 106. Tape straps 4, 6 then can be pulled from the tape reel cavities 26, 27 to provide slack in the tape to enable T-bar rod anchors 80, 81 to be unseated and removed from the anchor sockets 16, 17. Then the tension of spiral springs 46, 47 will provide enough force to rewind tape straps 4, 6 into their annular reel recess 54, 55 within the tape reel cavity 26, 27. Once the tapes have been fully rewound on their reels, the biasing force of the rewind springs will serve to firmly hold the T-bar rods 80, 81 in their respective anchor receiving cavities 12, 13. Then the handle 8 is folded down to its nested position (FIG. 3, and in solid lines in FIG. 5). In this condition, the package handle or carrier 2 can be easily stored in a shirt pocket or briefcase.

The package handle carrier 2 of the preferred embodiment has a modified rectangular shape with overall dimensions of $5'' \times 2\frac{1}{2}'' \times 1\frac{1}{4}''$. The four corners are cut off at a 45 degree angle from the sidewalls 18 and 19. This eliminates unused space and minimizes the volume and weight of the package handle carrier. Also, the irregular "wedge-end" shape provides for an easy ingress and egress to a shirt or coat pocket.

From the foregoing description and appended drawings, it will now be apparent that the package handle carrier of the present invention greatly facilitates the carrying of packages and equivalent over that hitherto employed and provides a sturdy, secure, compact and reusable package handle carrier enabling one hand carrying of packages and a space saving, easy fold up design for convenient storage.

It is also to be understood that the terminology as employed in the description and claims incorporated herein such as "upper", "lower", "left", "right", "front", "rear", etc., is used by way of description and not by way of limitation, to facilitate understanding of the structure, function and operation of the combination of elements which constitute the present invention. Moreover, while the foregoing description and drawings illustrate in detail one successful working embodiment of my invention, to those skilled in the art to which the present invention relates, the present disclosure will suggest many modifications in construction as well as widely differing embodiments and applications without thereby departing from the spirit and scope of the invention. The present invention, therefore, is intended to be limited only by the scope of the appended claims and the applicable prior art.

We claim:

1. A package handle carrier comprising a relatively flat, box-like casing for housing internal components, a handle pivotally connected to the exterior top of said casing and having a general U-shape for grasping by one hand, spring tensioned tape retracting reel means rotatably mounted in said casing with the rotational axis thereof perpendicular to the length and width dimensions of said casing, said reel means having fluted knob means protruding upwardly from the top of said casing, tape strap means connected at one end to said reel means and wound therein, anchor means attached to the other outer end of said tape strap means, said casing having anchor socket means for seating said anchor means, and releasable reel locking means yieldably engaged with said fluted knob means of said tape reel means and operable as a pawl and ratchet mechanism for preventing strap unwinding rotation of said reel means, whereby upon release of said reel locking means said tape strap means may be manually withdrawn and unwound from said tape reel means and tightly wrapped around a package or equivalent and connected at said anchor end to said casing anchor socket means, said tape means being continuously tensioned by said spring tensioned reel means, and upon engagement of said locking means and knob, said tape strap means cannot loosen from around the package, said handle thereupon being raised to an upright vertical position to carry by one hand said tape-engaged package.

2. A package handle carrier as set forth in claim 1 wherein said reel means comprises a pair of retractable spring tensioned tape reels rotatably mounted in said casing in side-by-side relationship with their axes parallel and their rotational axes perpendicular to the length and width dimension of said casing, said knob means comprising a pair of fluted knobs, one associated with each of said reels and protruding upwardly from the top of said casing, said tape strap means comprising a pair of tapes, one wound on each of said reels and connected at one end thereto, said casing having an end feed opening associated with just one of said tapes, said anchor sockets means comprising a first anchor socket located directly opposite said end feed opening, said casing having a side feed opening associated and located about 90 degrees from said end feed opening, said anchor socket means comprising a second anchor socket located directly opposite said side feed opening, said first and second tape straps being unwindable from said reels so as to perpendicularly cross one another on the underside of the package and tightly wrap around a package or equivalent for connection at said anchor ends thereof respectively to said first and second anchor sockets.

3. A package handle carrier as set forth in claim 1 wherein said anchor means comprises T-bar rod means which is attached to the outer end of said tape strap means and removably seats into said anchor socket means.

4. A package handle carrier set forth in claim 3 wherein said anchor socket means comprises an anchor slot in said casing which overlies an anchor clasp socket in said casing which provides a passage to an inclined anchor seat in said casing which removably receives said T-bar rod means.

5. A package handle carrier as set forth in claim 1 wherein said reel locking means comprises a reel lock housing, a lock spring keeper pin, a compression coil spring, and a reel lock detent slidable within said reel lock housing, said compression coil spring being captured between said lock spring keeper pin and said reel lock detent to yieldably urge said reel lock detent into contact with said fluted knob means of said tape reel means so as to function as a releasable pawl and ratchet mechanism to prevent said tape strap means from unwinding from said tape reel means and also to allow manual rotating of said knob means to take up any slack in said tape strap means.

6. A package handle carrier as set forth in claim 2 wherein said anchor means comprises first and second T-bar rods respectively attached to said first and second tape straps to removably respectively seat into said first and second anchor sockets.

7. A package handle carrier as set forth in claim 6 wherein each said anchor socket comprises an anchor slot in said casing which provides a passage to an inclined anchor seat which disposed beneath said slot in said casing and which removably receives said T-bar rod.

8. A package handle carrier as set forth in claim 2 including a pair of said reel locking means and wherein each of said tape reels has one of said pair of reel locking means individually associated therewith.

9. A package handle carrier as set forth in claim 1 wherein said handle is generally U-shaped, and comprises a central bight portion with a wave-shape molded onto the underside thereof to provide a finger grip area and a pair of legs, one at each end of said bight portion, each having an elongated opening to allow folding to a flat position individually over a pair of mounting ribs on the exterior top of said casing, said legs each having a pair of elongated slots in the sides thereof being for receiving a pivot pin therethrough, each said pivot pin being press fit mounted in a bore through the associated mounting rib and protruding into each said pair of elongated slots of each said handle leg, whereby the handle may move from a flat nested position to first slide out parallel to the plane of the length and width dimensions of said casing and then may be pivoted to an upright in-use position transverse to said plane.

10. A package handle carrier as set forth in claim 1 wherein said casing comprises a case which provides an open top base for an entire assembly and a case cover which is fixedly attached onto said case to close the same.

11. A package handle carrier as set forth in claim 10 wherein said casing has a perimeter wall defining a modified rectangular shape in plan view comprising side walls having parallel oppositely disposed center sections, slightly convergent opposite side wall portions extending lengthwise from said center sections and corner portions extending at 45 degree angles with respect to axes of said casing side walls and terminating at oppositely disposed parallel end walls said casing having a length, width and depth dimension in a respective ratio of 4:2:1.

12. A package handle carrier as set forth in claim 11 wherein a preferred embodiment of said casing measures $5'' \times 2\frac{1}{2}'' \times 1\frac{1}{4}''$.

13. A package handle carrier as set forth in claim 1 wherein said retractable spring tension reel comprises a molded piece consisting of a cylindrical skirt which acts as a rewind spring housing, and a bottom wall for partially defining an annular recess in the reel hub for receiving said tape strap, an anchor slot for hooking an outer end tang of a rewind spring to rotatably bias said tape reels for tape rewinding, an upper wall to further define said tape recess and also provide a platform for a bearing shoulder, and a fluted knob fixed to and protruding said bearing shoulder.

* * * * *